US009980572B2

(12) United States Patent
Thurow

(10) Patent No.: US 9,980,572 B2
(45) Date of Patent: May 29, 2018

(54) RETRACTABLE SOFA BED WITH HIDDEN MATTRESS PLATFORM AND GUIDE STOP WITH IMPROVED SECURITY

(71) Applicant: FLEXSTEEL INDUSTRIES, INC., Dubuque, IA (US)

(72) Inventor: Jerry A. Thurow, Dubuque, IA (US)

(73) Assignee: FLEXSTEEL INDUSTRIES, INC., Dubuque, IA (US)

( * ) Notice: Subject to any disclaimer, the term of this patent is extended or adjusted under 35 U.S.C. 154(b) by 186 days.

(21) Appl. No.: 14/833,784

(22) Filed: Aug. 24, 2015

(65) Prior Publication Data

US 2016/0183688 A1 Jun. 30, 2016

Related U.S. Application Data

(60) Provisional application No. 62/107,713, filed on Jan. 26, 2015, provisional application No. 62/040,597, filed on Aug. 22, 2014.

(51) Int. Cl.

| | |
|---|---|
| ***A47C 17/175*** | (2006.01) |
| ***A47C 17/165*** | (2006.01) |
| ***A47C 17/04*** | (2006.01) |
| ***A47C 17/16*** | (2006.01) |
| ***A47C 17/40*** | (2006.01) |
| ***A47C 17/17*** | (2006.01) |

(52) U.S. Cl.

CPC ..... *A47C 17/1756* (2013.01); *A47C 17/04* (2013.01); *A47C 17/162* (2013.01); *A47C 17/165* (2013.01); *A47C 17/17* (2013.01); *A47C 17/40* (2013.01)

(58) Field of Classification Search

CPC ..... A47C 17/00; A47C 17/04; A47C 17/162; A47C 17/165; A47C 17/17; A47C 17/1756; A47C 17/207; A47C 17/2076; A47C 17/40; A47C 1/032

See application file for complete search history.

(56) References Cited

U.S. PATENT DOCUMENTS

| | | | | |
|---|---|---|---|---|
| 120,270 | A * | 10/1871 | Hall | A47C 17/1655 297/118 |
| 2,142,577 | A * | 1/1939 | Vallone | A47C 17/17 5/44.1 |
| 2,534,175 | A * | 12/1950 | Lorenz | A47C 17/165 5/43 |
| 2,534,177 | A | 12/1950 | Lorenz et al. | |
| 2,634,429 | A * | 4/1953 | Hopeman, Jr. | A47C 17/165 297/118 |

(Continued)

OTHER PUBLICATIONS

Day Bed Data Sheet Sales Literature, 8 pages dated Dec. 2000.

(Continued)

*Primary Examiner* — David E Sosnowski
*Assistant Examiner* — David R Hare
(74) *Attorney, Agent, or Firm* — Ladas & Parry LLP

(57) ABSTRACT

A sofa bed with a seat back assembly, seat, side frame assembly and lock and release member. The side frame assembly includes a side frame and a link assembly connected to the side frame. The link assembly moves between a first position and a second position to allow for conversion of the sofa bed between a sofa position and a bed position. The lock and release mechanism locks the link assembly in place.

12 Claims, 17 Drawing Sheets

(56) References Cited

U.S. PATENT DOCUMENTS 2,644,170 A * 7/1953 Kelly, Jr. ..... A47C 17/165 5/136
2,644,171 A 7/1953 Lorenz et al.
3,042,935 A * 7/1962 Nielsen ..... A47C 17/162 5/47
3,164,849 A * 1/1965 Poskin ..... A47C 17/17 5/41
3,520,006 A * 7/1970 Walstad ..... A47C 17/165 5/29
3,975,783 A 8/1976 Pringle
4,045,829 A 9/1977 Pringle
4,097,938 A * 7/1978 Pringle ..... A47C 17/04 384/219
4,106,137 A * 8/1978 Leclerc ..... A47C 17/165 5/12.1
4,321,717 A * 3/1982 Serra ..... A47C 7/725 362/131
4,829,611 A 5/1989 Fireman et al.
4,860,393 A 8/1989 Schefthaler
4,875,244 A * 10/1989 Tremblay ..... A47C 17/1753 5/37.1
5,067,187 A 11/1991 Messina
5,271,109 A * 12/1993 Markel ..... A47C 17/1756 5/37.1
5,509,151 A 4/1996 Fireman et al.
5,904,401 A * 5/1999 Alberda ..... A47C 17/2076 297/354.13
6,349,431 B1 * 2/2002 Meade ..... A47C 17/162 5/37.1
7,607,180 B2 * 10/2009 Griepentrog ..... A47C 17/165 5/43
9,314,104 B2 * 4/2016 Stieglitz ..... A47C 17/1655
9,468,303 B2 * 10/2016 Garland ..... A47C 17/04
2015/0230620 A1 * 8/2015 Guyvoronskiy ..... A47C 17/40 5/136
2016/0037933 A1 * 2/2016 Grossman ..... A47C 17/1756 5/37.1
2016/0150887 A1 * 6/2016 Wallis ..... B60N 2/00 297/283.2
2017/0332797 A1 * 11/2017 Thurow ..... A47C 17/17

OTHER PUBLICATIONS

Blueprint 3453LS 3453RS Flexsteel Industries Incorporated, Dubuque Iowa 52001: dated May 14, 1998, offered for sale on Jan. 29, 1999 (color copy converted to black and white).
Blueprint 3453MLA 3453MRA Flexsteel Industries Incorporated, Dubuque Iowa 52001, dated May 18, 1996, offered for sale on Jan. 29, 1999 (color copy converted to black and white).
Blueprint 3453SF Flexsteel Industries Dubuque, Iowa 52001; dated May 20, 1998, offered for sale on Jan. 29, 1999 (color copy converted to black and white).
Blueprint 3453BF, Flexsteel Industries, Inc. Dubuque, Iowa, 52001; dated May 28, 1998, offered for sale on Jan. 29, 1999 (color copy converted to black and white).

* cited by examiner

RETRACTABLE SOFA BED WITH HIDDEN MATTRESS PLATFORM AND GUIDE STOP WITH IMPROVED SECURITY

CLAIM OF PRIORITY

This application claims priority from U.S. Provisional Application Ser. No. 62/040,597 filed Aug. 22, 2014, having the same title and inventor and U.S. Provisional Application Ser. No. 62/107,713 filed Jan. 26, 2015 entitled DAY BED WITH IMPROVED SECURITY.

BACKGROUND OF THE INVENTION

Field of the Invention

The present invention relates generally to a furniture assembly, and more particularly, to a sofa bed or convertible bed having a mechanism for securing the furniture assembly in an appropriate position.

Background

A sofa bed is usually a sofa with a seating surface, a back surface, and arms, which includes a foldable bed located in the area below the seating surface. When being used as a sofa, it as appears as any regular sofa designed for seating. When the user wishes to use the sofa bed to convert to a bed, he typically removes the seat and back cushions and pulls out and unfolds the foldable bed contained within. Examples of this type of arrangement are disclosed in U.S. Pat. Nos. 2,644,171 and 3,975,783.

These sofa beds, while providing a convenient way to provide for overnight guests, have their disadvantages. The mattress is typically thin so that it may be folded when the bed is stored in the sofa. This thin mattress is supported by a metal frame work between which is spread a fabric. Often times the fabric provides insufficient support causing the sleeping surface to sag while the rigid metal frame work causes ridges of hardness. The combination of the sag and the ridges provides an uncomfortable sleeping surface. Further, there is the matter of storing the sofa cushions that are removed. To access and deploy the bed, the seat cushion of the sofa must be removed. The cushions are light in weight, but they are bulky and must be stored somewhere while the bed is in use. Likewise, if the sofa has back cushions, those must be stored as well. Furniture may also have to be moved in order to deploy the bed as is the case if a coffee table is located in front of the sofa.

Another type of sofa bed utilizes the rear of the seat back as the sleeping surface. The seat back is usually mounted on a pivot so that the seat back can be rotated to a horizontal position so that the rear surface faces down and the rear surface faces up. This type of assembly is disclosed in U.S. Pat. No. 4,106,137. This arrangement provides a better sleeping surface than the former as the bed or mattress does not need to be foldable. This does away with the associated folding metal framework that caused ridges of hardness across the sleeping surface. Another advantage is that the furniture does not need to be moved relative to the floor or room wall to deploy the bed. However, this arrangement is not without its disadvantages as the seat cushions and any back cushions must still be removed to deploy the bed. While this may not be an onerous burden to all, there may not be a convenient place to store the cushions. If the bed is being used in a hotel where housekeeping staff is expected to prepare the bedding, time may be lost in removing or replacing the cushions each time the bedding is changed. Likewise, a hotel guest does not want to be burdened with a cumbersome conversion from one configuration to the other and storage of seating components such as cushions.

In addition, many sofa beds and lounge chars are intended to be situated in certain locations. For example, a sofa bed may be configured for placement against a wall. In this case, placement against the wall restricts access to certain mechanisms of the sofa bed that might be hazardous to an owner, guest, etc. For example, the wall may act as a form of protection against the unintentional conversion of the sofa bed from the sitting position to the sleeping position. Unfortunately however, owners and guests are known to move the day beds away form their designated locations. Moreover, it is beneficial for the sofa bed to easily convert from the sofa position to the bed position. However, slamming the sofa bed open or shut during conversion can be hazardous if precautions are not taken.

The present invention solves the problems described above. The sofa bed described herein provides a superior sleeping surface over that of the foldable beds. The sofa bed is easily convertible from the seating configuration to the sleeping configuration without the removal of the seat cushions, and also provides a mechanism for locking the sofa bed in place to prevent unintended conversion. The back portion and the seating portion are mechanically linked though a link assembly so that rotating the back portion retracts the seating portion into the sofa frame. The link assembly provides a mechanism for locking the bed in a particular position such as the sofa position. The design allows for a made bed to be available by a simple rotation of the seat back of the sofa, but also improves security by preventing unintentional conversion of the bed. This sofa bed is therefore particularly adaptable where space is at a premium, ease of storage an advantage and it is uniquely adapted to situations such as that found in the hospitality, resort or even cruise ship environments.

BRIEF DESCRIPTION OF THE FIGURES (NON-LIMITING EMBODIMENTS OF THE DISCLOSURE)

FIGS. 1*a* and 1*b* are perspective views showing a sofa bed in the bed position and sofa position respectively according to an embodiment of the present invention.

FIG. 2 is a perspective view of a sofa bed in the sofa position with the side frames, front bar and cross-member exposed according to an embodiment of the present invention.

FIG. 3*a* is a front elevational view of a sofa bed in the sofa position according to an embodiment of the present invention.

FIG. 3*b* is a side elevational view of the sofa bed in which internal details of the sofa bed are illustrated.

FIG. 4*a* is a front elevational view showing a sofa bed between the sofa position and the bed position according to an embodiment of the present invention.

FIG. 4*b* is a side elevational view of the sofa bed in which internal details of the sofa bed are illustrated.

FIG. 5*a* is a front elevational view showing a sofa bed in the sofa position according to an embodiment of the present invention.

FIG. 5*b* is a side elevational view of the sofa bed in which internal details of the sofa bed are illustrated.

FIG. 6*a* is a top plan view of a seat back frame having the spring suspension partially cutaway according to an embodiment of the present invention.

FIG. 6*b* is a front elevational view of the seat back frame.

FIG. 6*c* is a side elevational view of the seat back frame.

FIG. 7*a* is a top plan view of the seat frame having the seat spring suspension partially cutaway.

FIG. 7*b* is a sectional view of the seat frame.

Figure 10B:
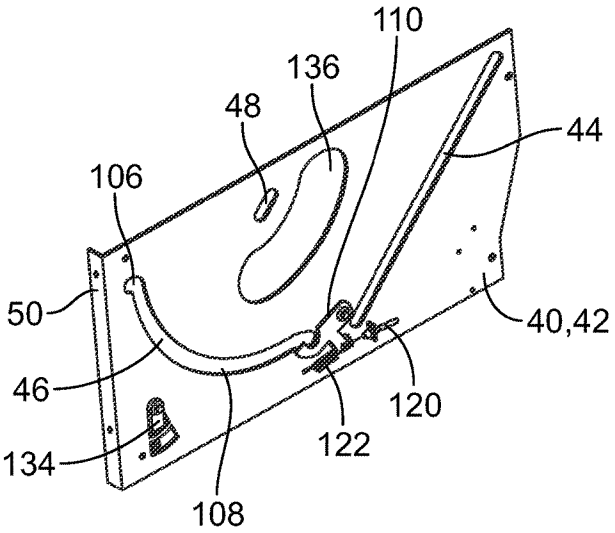
Figure 10A:
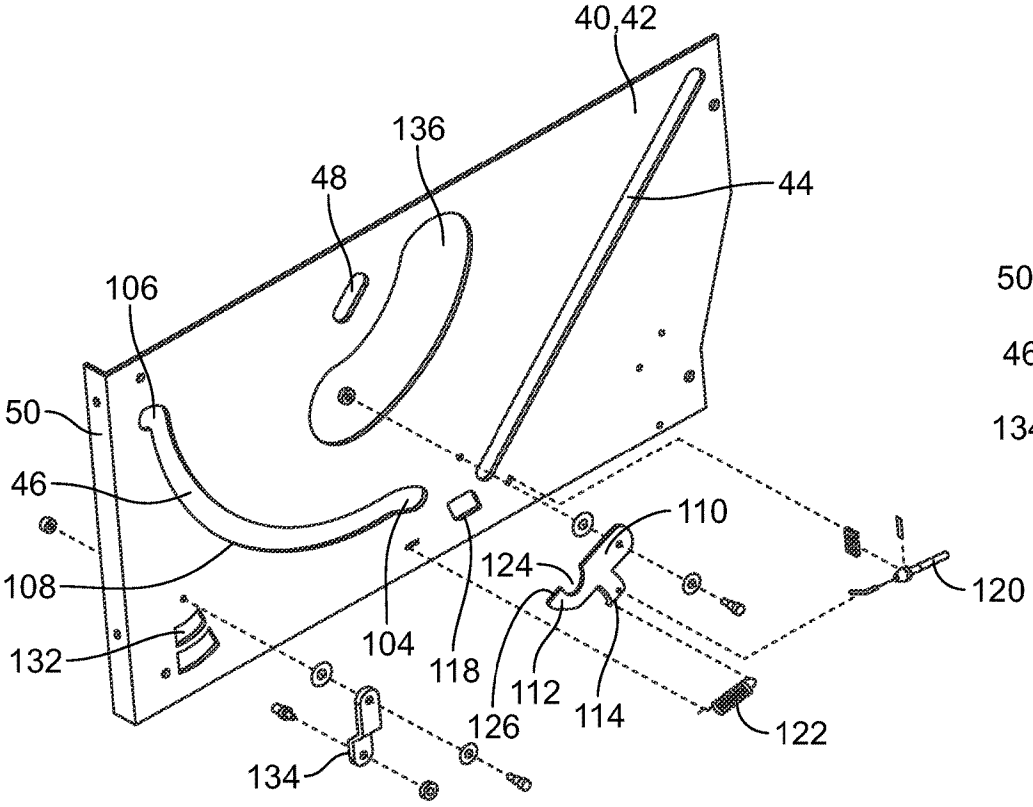

FIG. 10*a* is an exploded perspective view of the right side frame when viewed from the side of the right side frame that faces the seat frame.

FIG. 10*b* is a perspective view of the right side frame.

Figure 11:
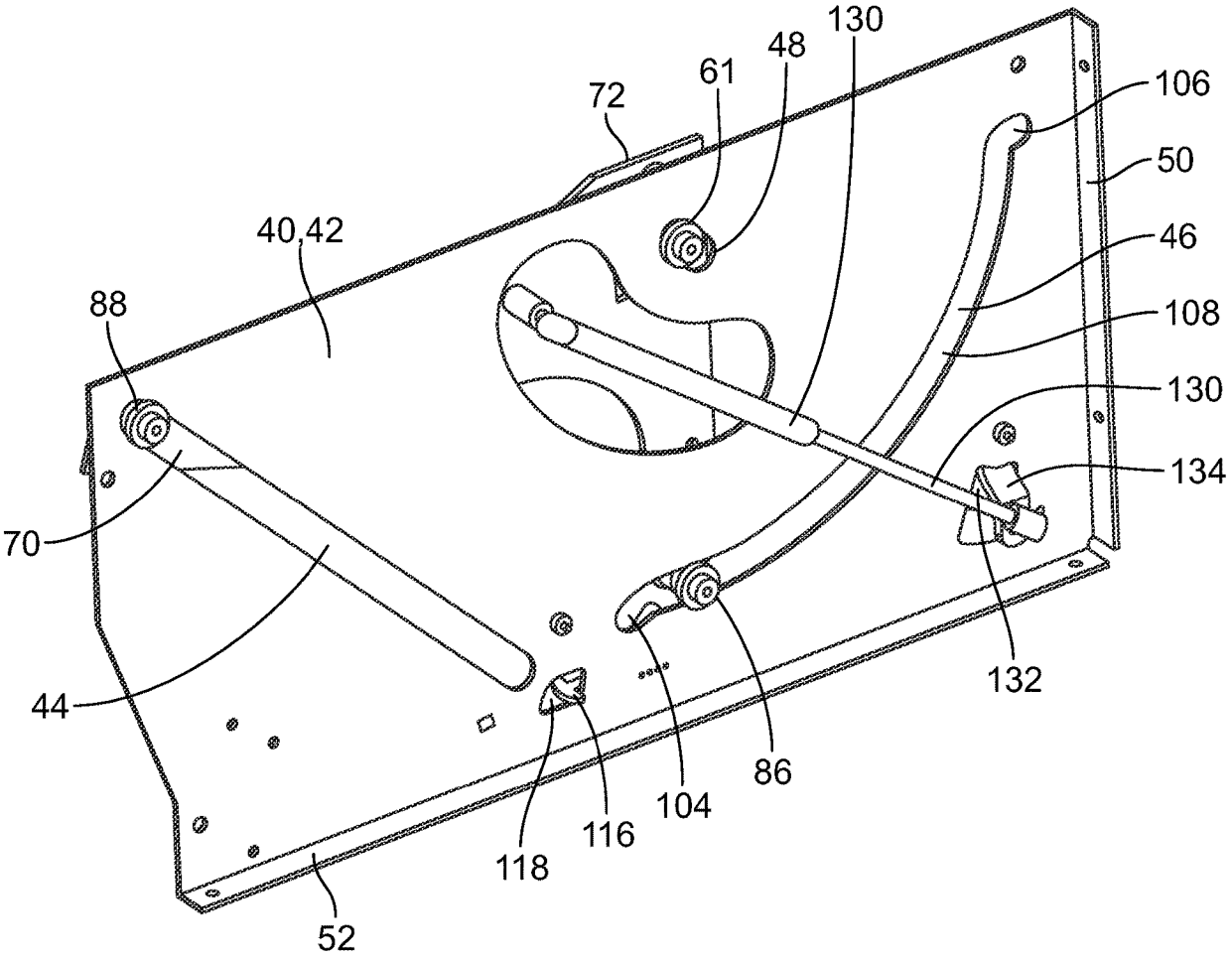

FIG. 11 is a perspective view of the right side frame and link assembly.

Figure 12:
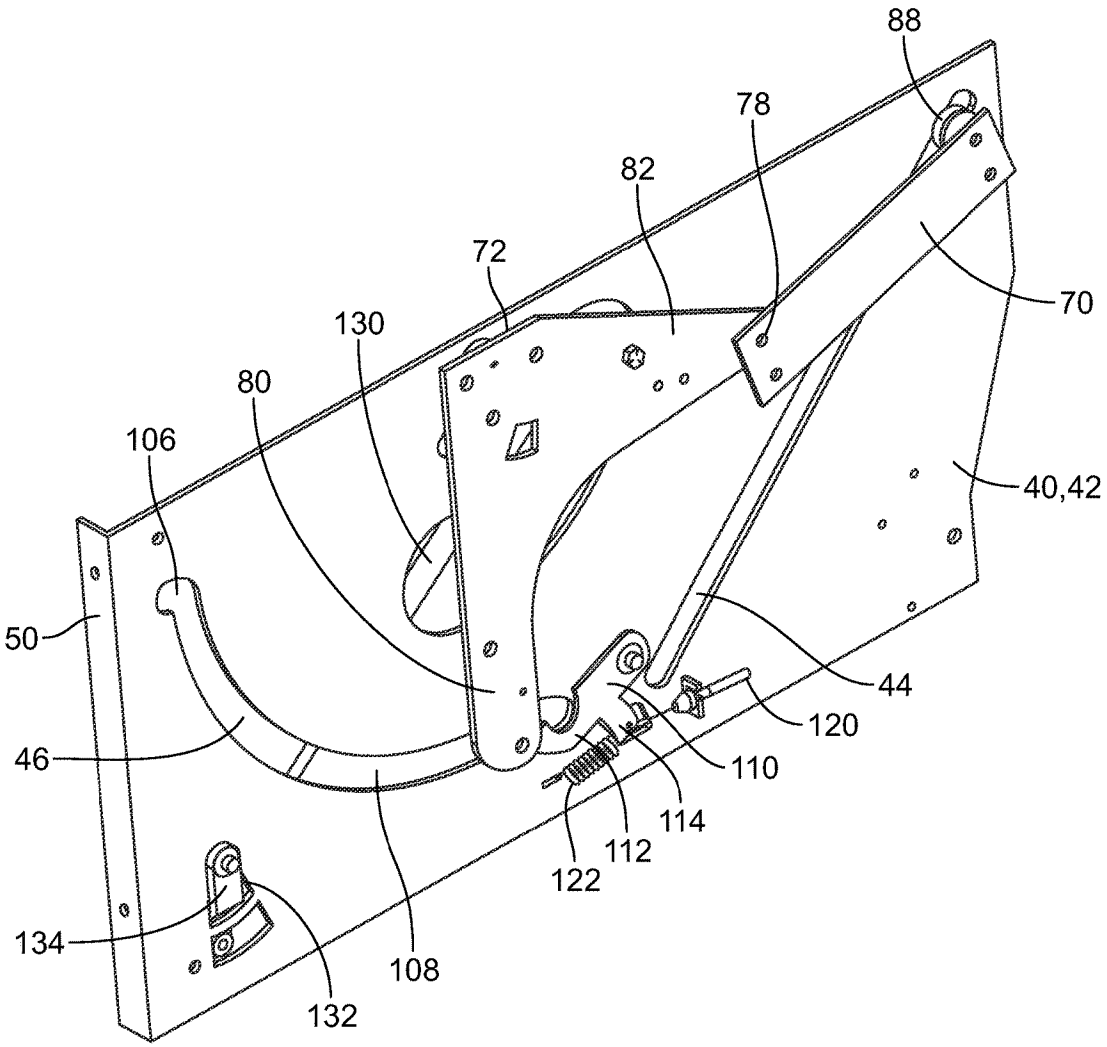

FIG. 12 is a perspective view of the right side frame and link assembly when viewed from the side of the right side frame that faces the seat frame.

Figure 13:
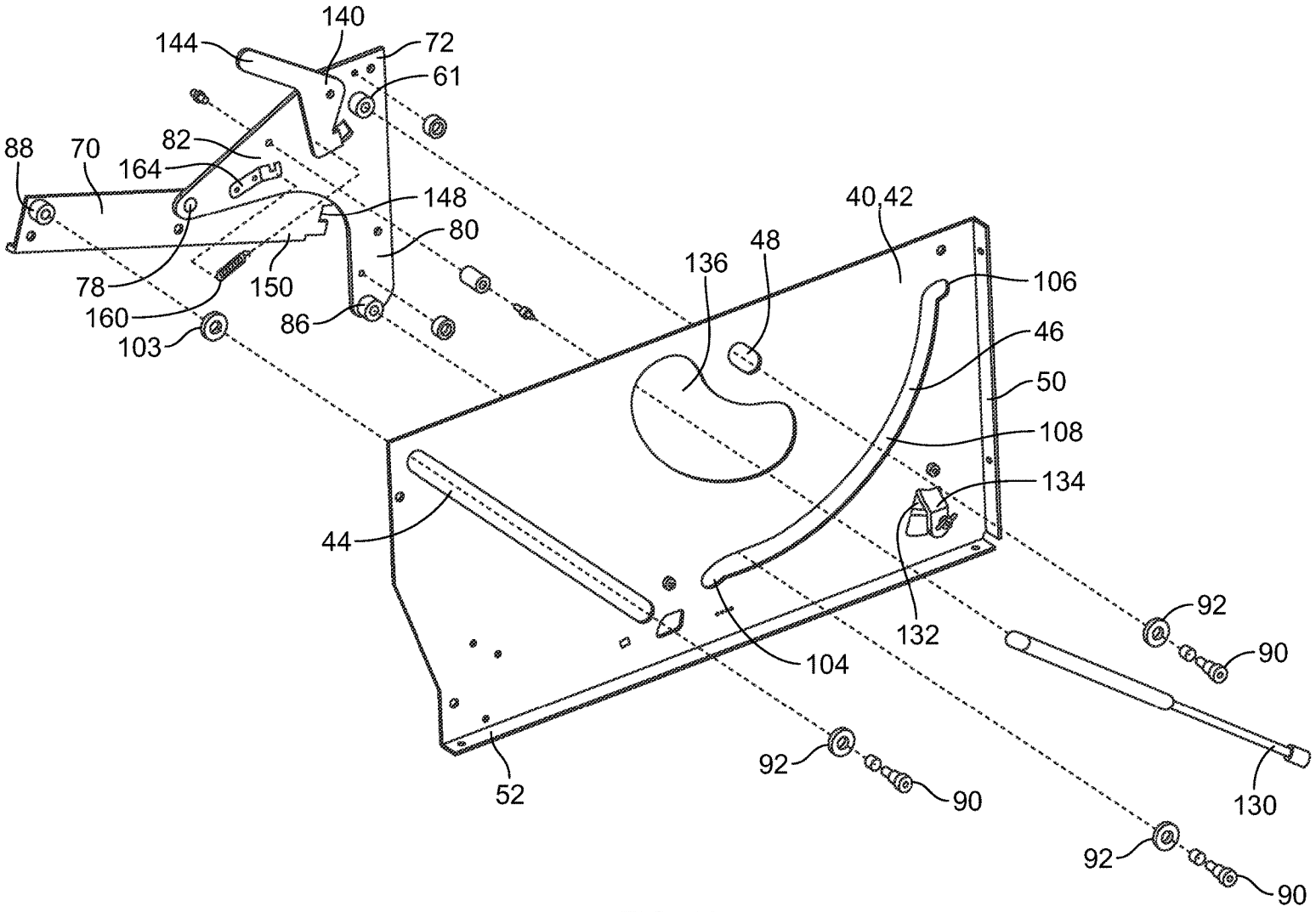

FIG. 13 is an exploded perspective view of a right side frame and link assembly according to another embodiment of the present invention.

Figure 14:
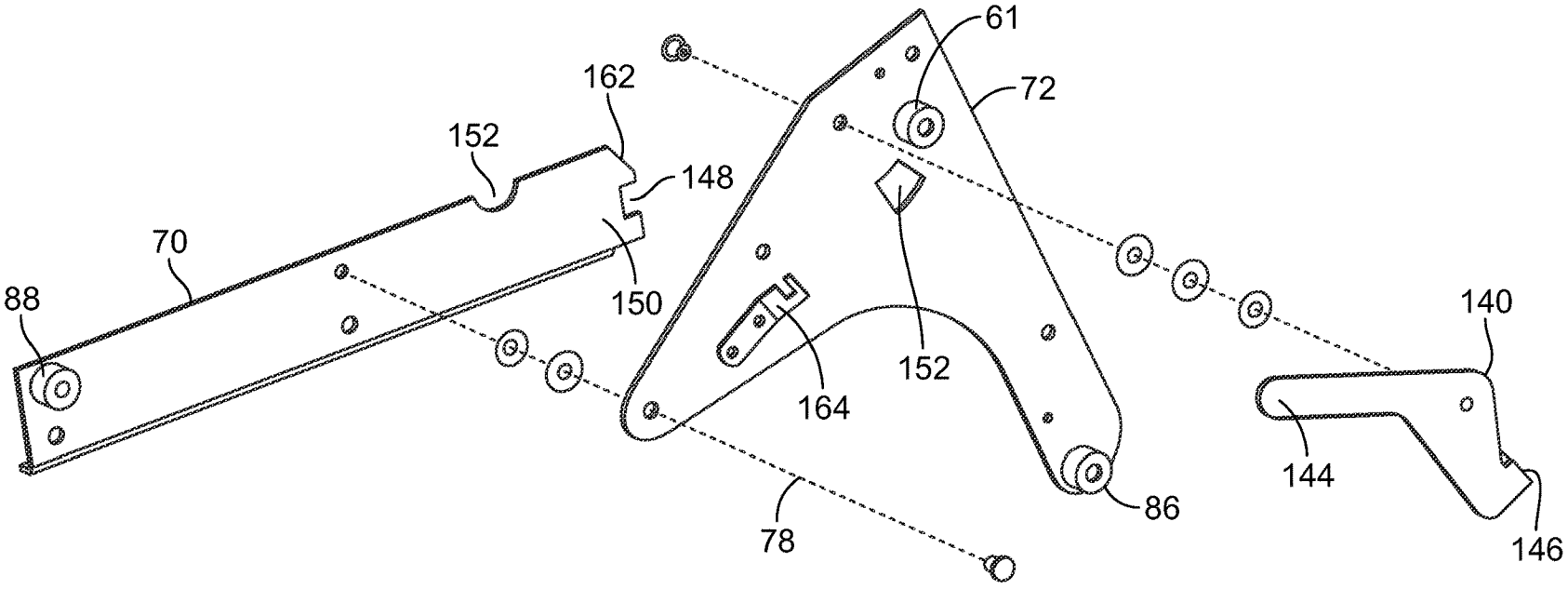

FIG. 14 is an exploded perspective view of the link assembly including the crank member and the seat link member.

Figure 15B:
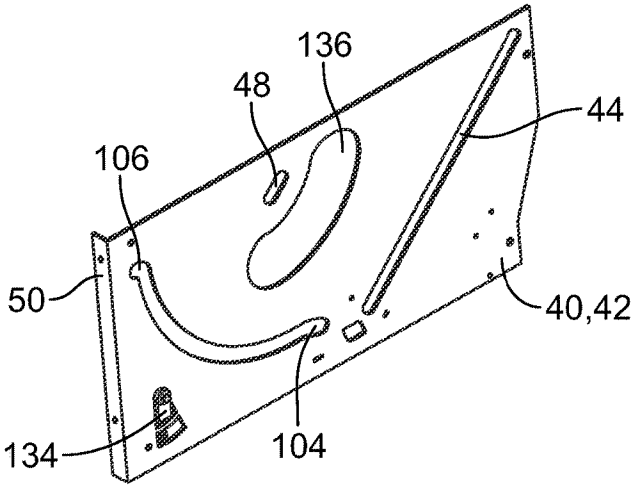
Figure 15A:
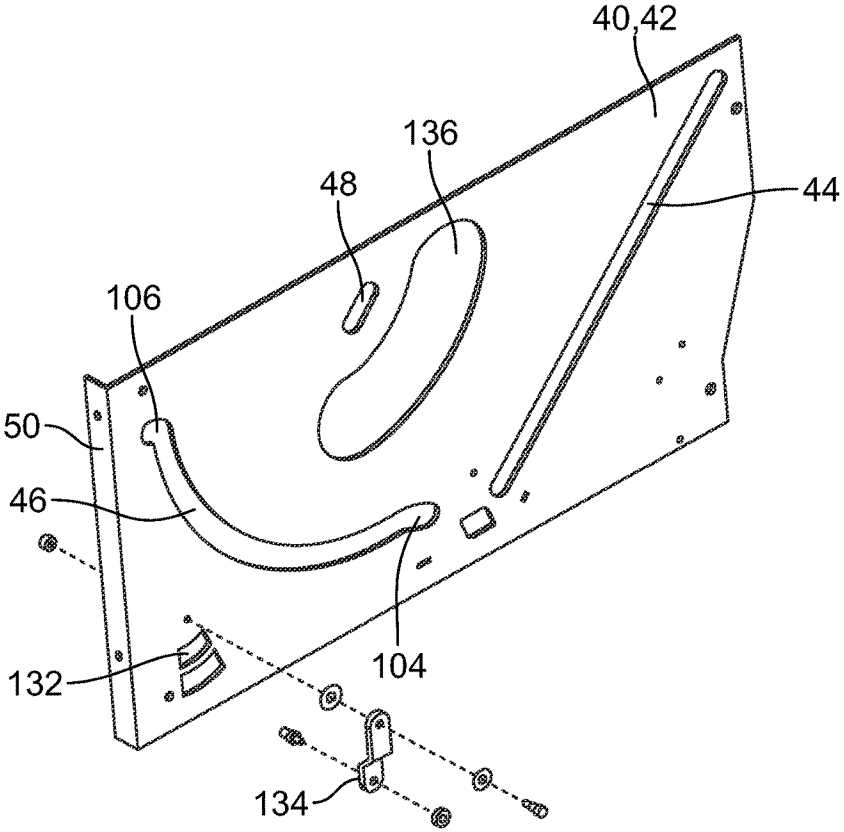

FIG. 15*a* is an exploded perspective view of the right side frame when viewed from the side of the right side frame that faces the seat frame.

FIG. 15*b* is a perspective view of the right side frame.

Figure 16:
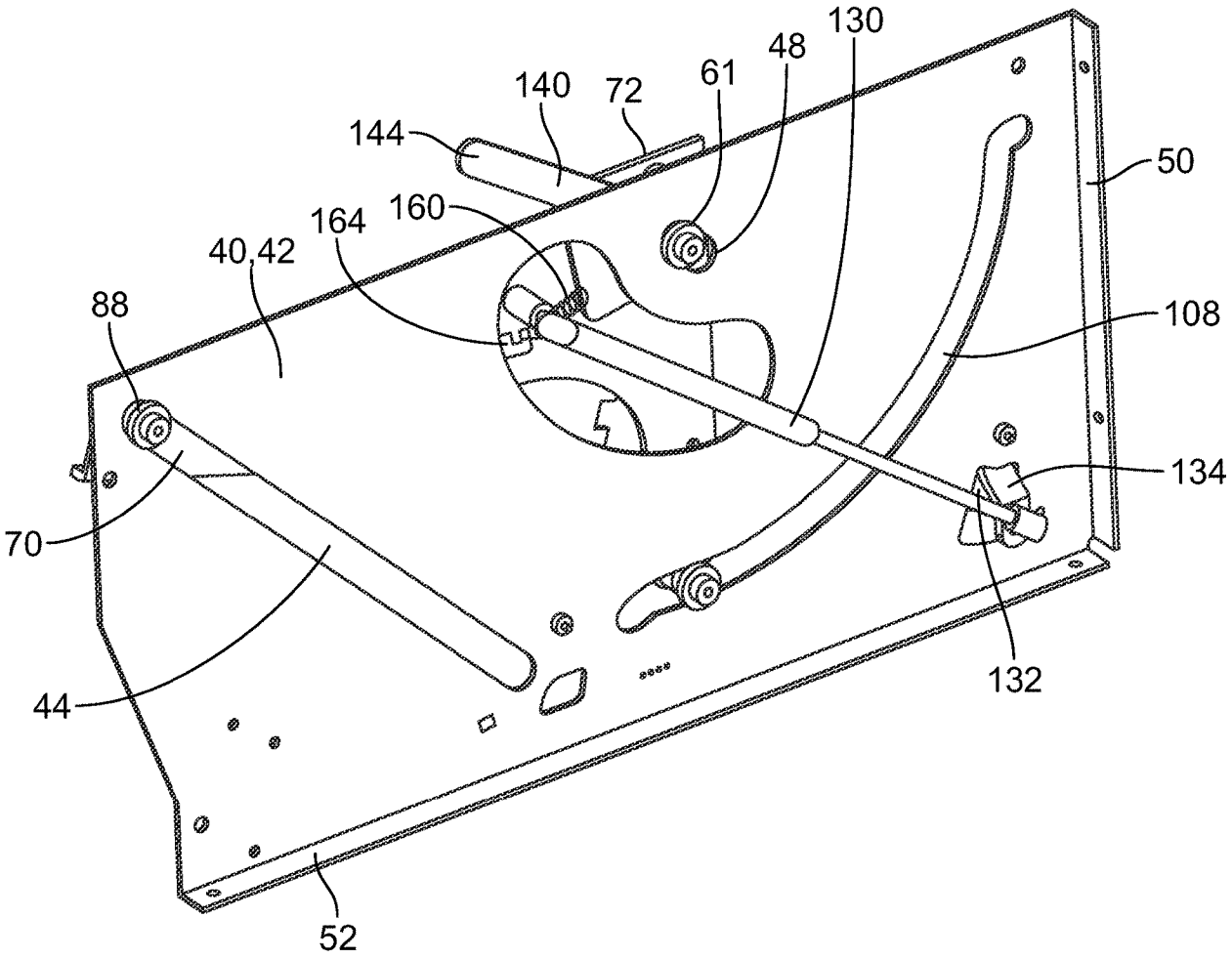

FIG. 16 is a perspective view of the right side frame and link assembly.

Figure 17:
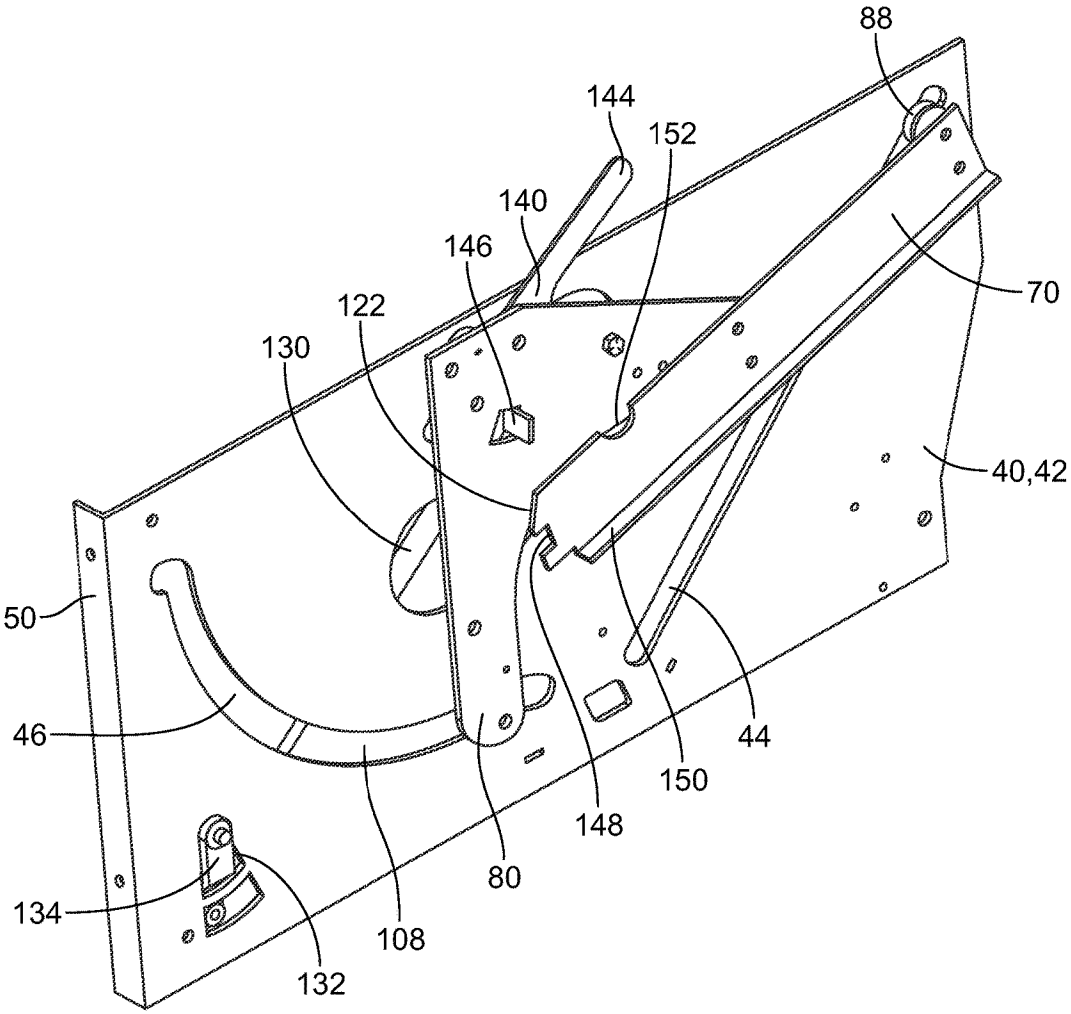

FIG. 17 is a perspective view of the right side frame and link assembly when viewed from the side of the right side frame that faces the seat frame.

Figure 18A:
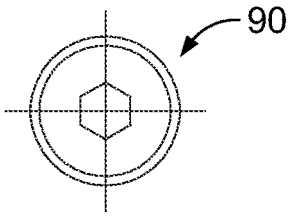

FIG. 18*a* is a top plan view of a shoulder bolt used in a pivoting connection.

Figure 18B:
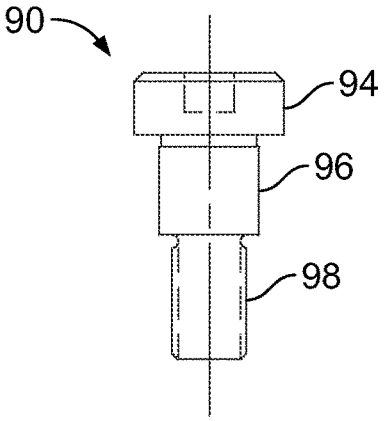

FIG. 18*b* is a front elevational view of the shoulder bolt.

Figure 18C:
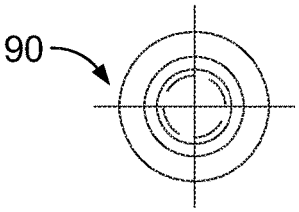

FIG. 18*c* is a top plan view of another aspect of the shoulder bolt having an alternative screw drive type.

Figure 19A:
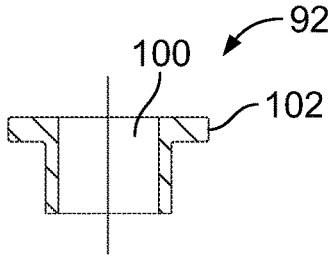

FIG. 19*a* is a sectional view of a flanged busing used in a pivoting connection.

Figure 19B:
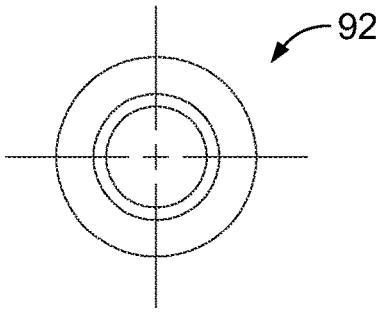

FIG. 19*b* is a top plan view of the flanged bushing.

DETAILED DESCRIPTION

Figure 6B:
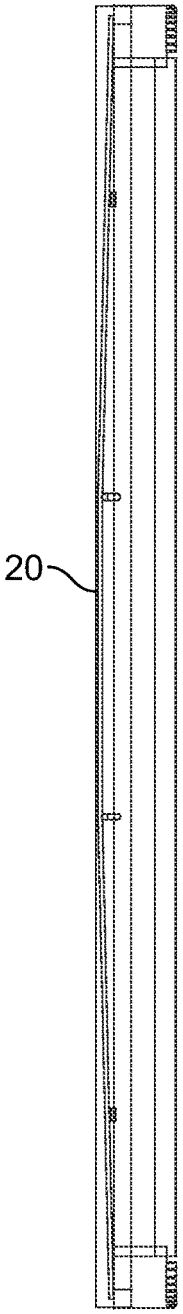
Figure 6A:
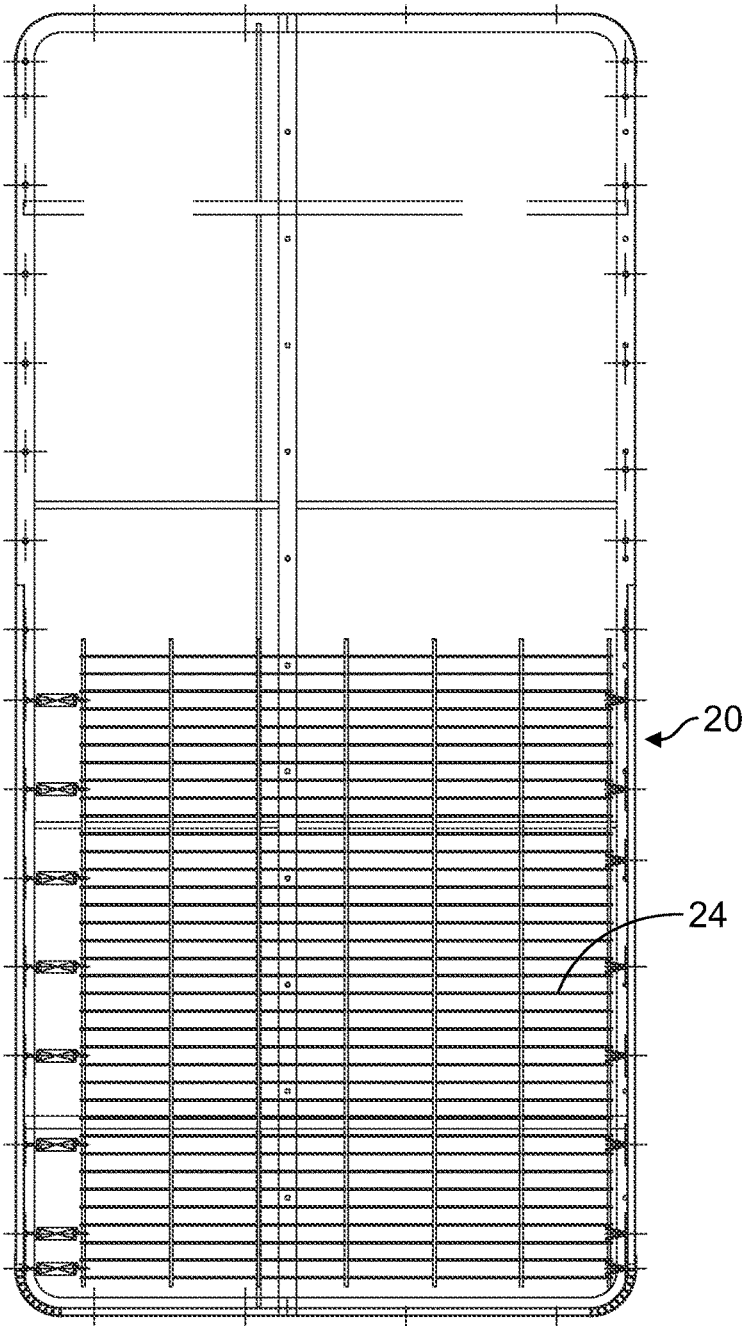
Figure 6C:
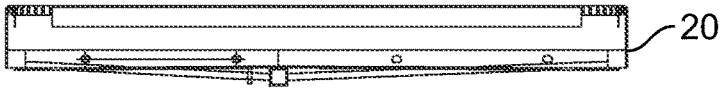

Referring to the drawings, the sofa bed 10 of this invention is generally shown. The sofa bed 10 includes seatback assembly 12 with mattress 14 and seat 16. Mattress 14 is mounted on seat back frame 20 as more fully described below. Frame 20 is pivotally mounted between two side frames 40, 42, one located on either side of the sofa bed. Seat back frame 20 could be a solid platform, such as used to support a foam mattress, or preferably a perimetrical frame 22 adapted to a spring suspension 24 for supporting the mattress 14. This is shown in greater detail in FIGS. 6*a*-6*c*.

Figure 7B:
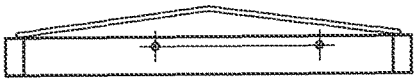
Figure 7A:
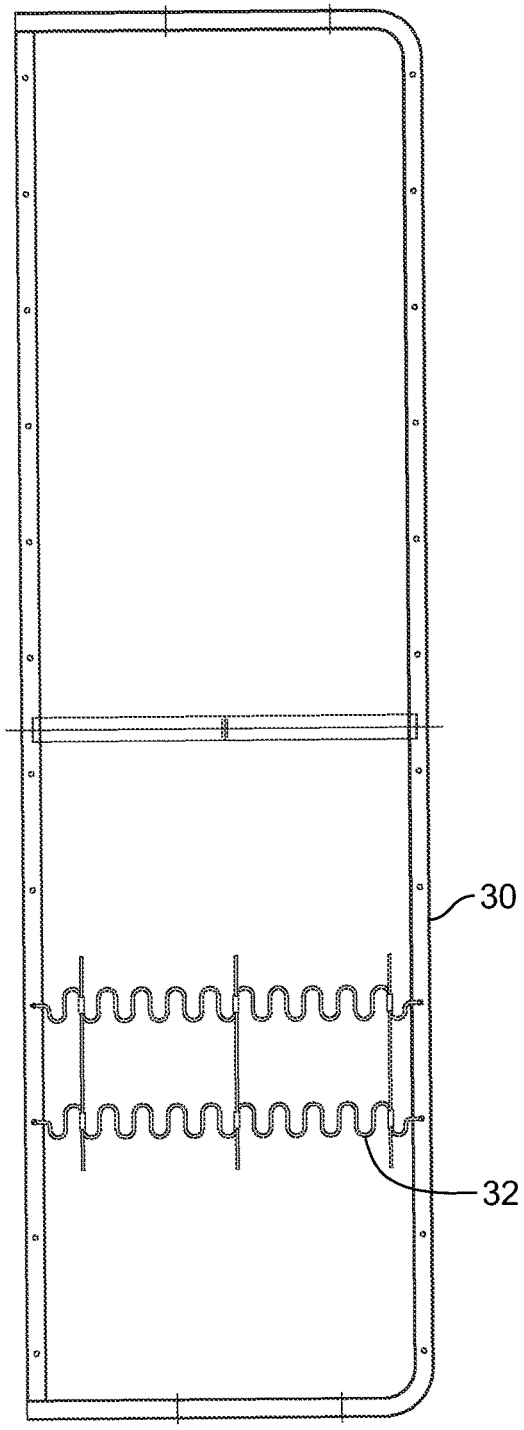

Seat frame 30 supports seat cushion 31 on typical upholstered furniture springs 32, such as the sinuous wire springs shown, ore alternatives for which are known to one of ordinary skill in the art, including those discussed above with respect to the spring suspension 24. Seatback assembly or mattress platform 12 also includes seat back cushion 26 on the side opposite mattress 14. The seatback cushion 26 is attached to the front face of the seat back frame 20 supported by seat back springs 27. These may be a wire spring grid, as shown in FIG. 7*a*, or other suspension arrangements familiar to one of ordinary skill, such as straps, sinuous wire or leaf type springs.

Figure 1A:
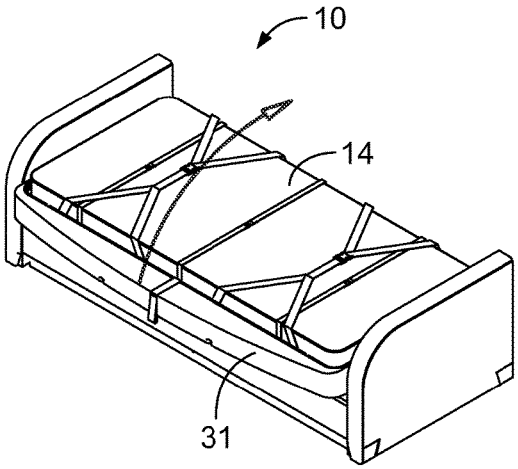
Figure 1B:
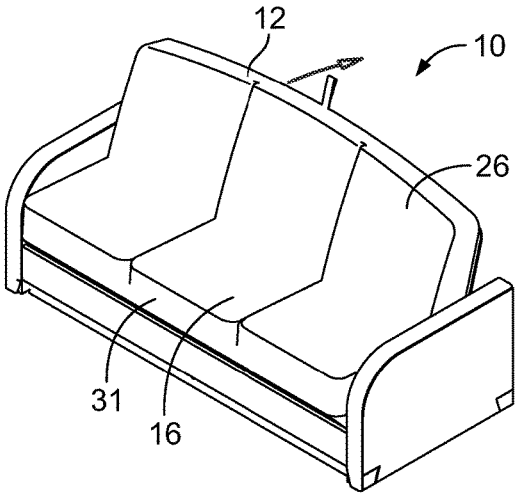
Figure 2:
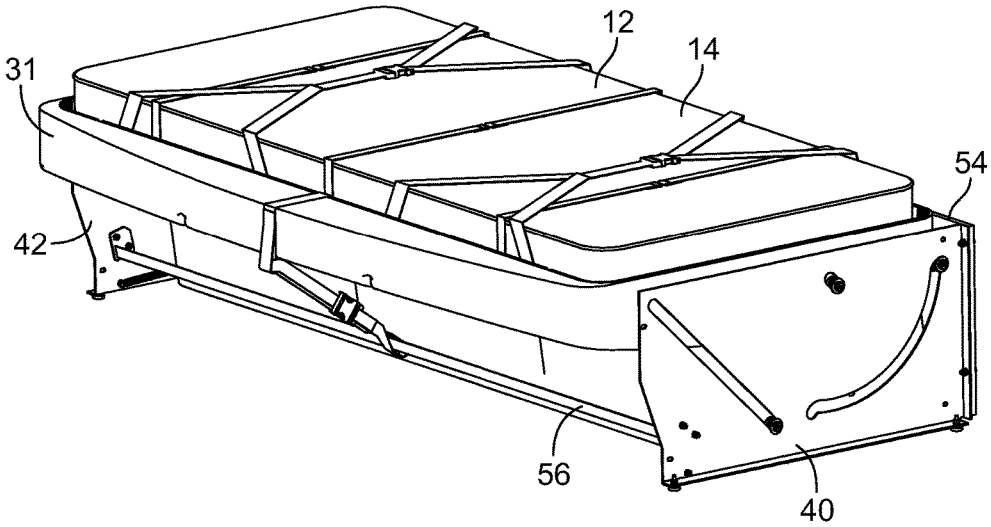
Figure 3A:
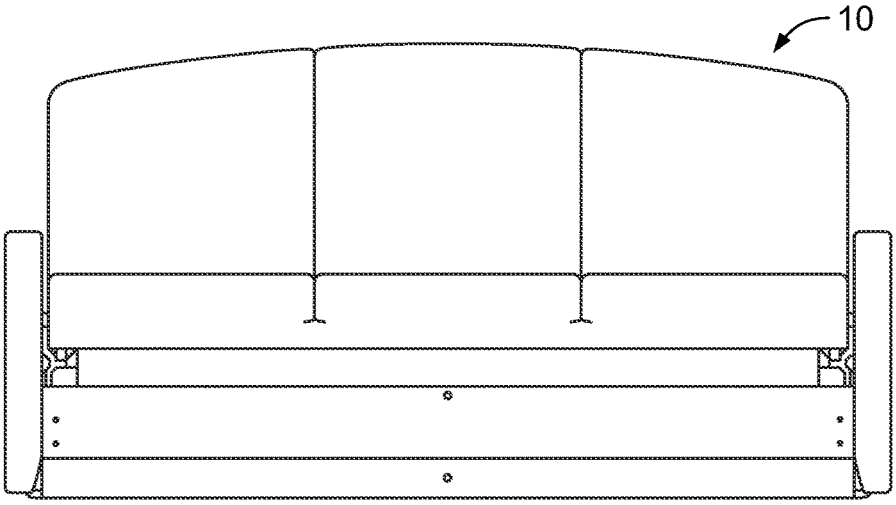
Figure 3B:
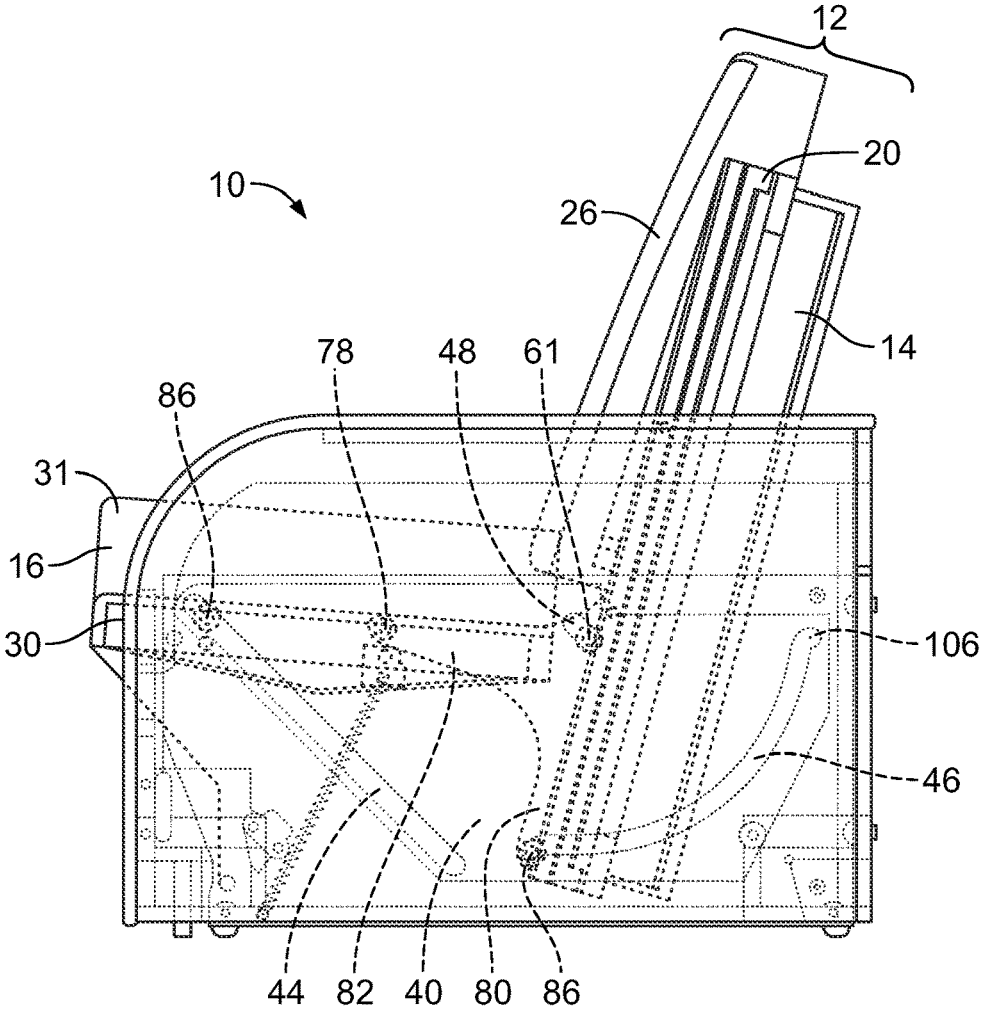

Because cushion 26 is opposite mattress 14, cushion 26 is usable when the sofa bed 10 is deployed in the sofa condition, which is illustrated in FIG. 1*b* and FIGS. 3*a*-3*b*. The mattress 14 being secured to the rear face is usable when the sofa bed 10 has seat 16 retracted and seatback assembly 12, linked thereto, is deployed in the bed condition, which is illustrated in FIGS. 1*a*, 2 and 5*a*-5*c*. It will be noted that an upholstery trim piece 29 is fitted to provide both aesthetic and functional attributes of retaining and protecting mattress 14. This is removed in FIG. 2 for a better view of frame 40. An upholstery trim piece may be fitted over seat back frame 20 to provide both aesthetic and functional attributes of retaining and protecting mattress 14.

Side frames 40, 42 are mirror images of each other, and the seatback assembly 12 and seat 16 are positioned between the side frames 40, 42. The side frames 40, 42 shown in FIG. 2 and FIGS. 3*a*-5*b* are simplified versions of the side frame in which the locking and release mechanism is omitted. Each side frame connects to a link assembly 76. The link assembly 76 attaches the side frame to seatback assembly and seat 16 and allows for conversion of the sofa bed between the sofa position and the bed position. FIG. 3*b* shows the position of certain elements of the link assembly 76 when the sofa bed 10 is in the sofa position. FIG. 4*b* shows the position of certain components of the link assembly 76 during conversion of the sofa bed between the sofa position and the bed position, and FIG. 5*b* shows the position of certain components of the link assembly 76 when the sofa bed 10 is in the bed position.

FIGS. 8-17 are detailed perspective views of the side frames 40, 42 along with the link assembly 76 and lock and release mechanism 110 according to embodiments of the present invention. The side frame depicted in these drawings is the right side frame 40 (see FIG. 2) when looking toward the sofa bed. As noted above, the left side frame 42 is simply the mirror image of the right side frame 40. FIGS. 8-12 show the side frame 40, link assembly 76 and locking and releasing mechanism 110 according to embodiments in which a hook and cable locking and releasing mechanism 110 is provided so that the sofa bed 10 is locked while in the sofa position and then released upon activation of release cable 120.

Referring to FIGS. 8-12, side frame 40, as would its mirror image 42, include a diagonal guide 44 and an arcuate guide 46 located to the rear of the diagonal guide 44. In an embodiment, these guides are slots in the side frame 40, 42. Frames 40, 42 can be advantageously formed of sheet metal, such as steel in a thickness of about ⅛" which has advantages of economy, strength and ease of formation with well known mechanical properties. Other materials could be suitable in particular environments, such as aluminum or stainless steel in marine environments. Preferably, accurate guides 44, 46, and angled pivot slot 48 can be cut by laser using computer controlled manufacturing techniques.

Additional advantages to using solid sheet include the substantial elimination of linkage requiring assembly; the ability to be formed through automated manufacturing means such as laser cutting or other appropriate machining, and the elimination of braces between the tracks or guides 44, 46 and slot 48, all of which can be more easily maintained in position by the presence of the solid web between them.

It will be noted the side frame 40 in FIGS. 1-3 has slight differences in geometry from the preferred frame 42 in FIGS. 10-11. Either may be used without departing from the spirit of the invention. The first embodiment has a slightly lower profile, being substantially below the sofa arm (shown in phantom lines) and uses a bracket fixed preferably tubular metal cross member 49 to connect opposed side frames 40, 42. The second embodiment may be more economical and better adapted to installation using wooden boards, or similar material, spanning the side frames 40, 42, front and rear.

Each of the side frames 40, 42 has a pair of outwardly depending flanges 50, 52. In both the right side frame 40 and the left side frame 42, the flanges 50, 52 will be on the bottom and rear, respectively. These add rigidity, provide a larger load bearing surface and enable fastening to a floor, wall or, in cases like cruise ships, the corresponding deck and bulkheads, as well as enabling the cross member or spacer 54 (see FIG. 2) to be simply and directly fastened.

Panels, boards and/or metal bars may be used as cross members or spacers to connect the front and rear portions of the side frames 40, 42. The use of wooden panels has advantages in economy, strength, stiffness and weight, while being easily cut and easily upholstered due to the ease with which upholstery fasteners can be efficiently received. The rear cross member 54 is advantageously used as a structural member. The front panel or bar 56 can be adapted in a number of ways to either interconnect frames 40, 42 directly, or to interconnect upholstered arms directly, the arms being mounted to frames 40, 42 (see FIG. 2). This front panel can be advantageously fastened using commercially available manually engageable cam action locks or other appropriate fasteners which will permit easy application in the field, and enable the occasional reupholstery need by more easily enabling removal.

The side frames 40, 42 also have pivot slot 48 which receives main pivot 61 around which the seatback frame 20 may rotate. Pivot slot 48 also permits and imparts upward and forward movement as the seatback 12 is moved, as will be described more fully below. It will be noted that pivot 61 is spaced from the extreme top and bottom edges of frame 20 which thereby provides a semi-balanced condition easing pivoting movement yet enable substantially sure locking in the two desired positions.

A pair of seat link members 70 are attached to crank members 72. Seat link members 70 are attached to opposite sides of the seat frame 30. The seat link members 70 and attached crank members 72 together are referred to as a link assembly 76.

Each seat link member 70 is rigidly attached to the seat frame 30, and pivotally connected to the corresponding crank member 72 at pivot joint 78. It should be noted that seat link member 70 may be placed in an inverted position in order to provide greater clearance for a thicker cushion, or to alternatively raise the height of frame 30. Crank member 72 is mounted to the seat back frame 22 having arm 80 directly affixed to frame 22 and leg 82 extending to the attachment at the pivot joint 78. In combination with the guide geometry disclosed, a smooth, sure action is provided.

Each crank member 72 is pivotally and slidably connected to the pivot slot 48 of the side frame 40, 42 by way of the main pivot 61, which is located where the leg 82 and arm 80 meet. The arm 80 includes a seat back bearing connection 86 for connecting the arm to the arcuate guide 46 of the side frame 40, 42. The connection of the arm to the arcuate guide 46 can be considered a generally slidable connection. Seat link member 70, in addition to the pivotal connection at pivot joint 78 with crank member 72, has a slidable connection 88 with diagonal guide 44.

Figure 4A:
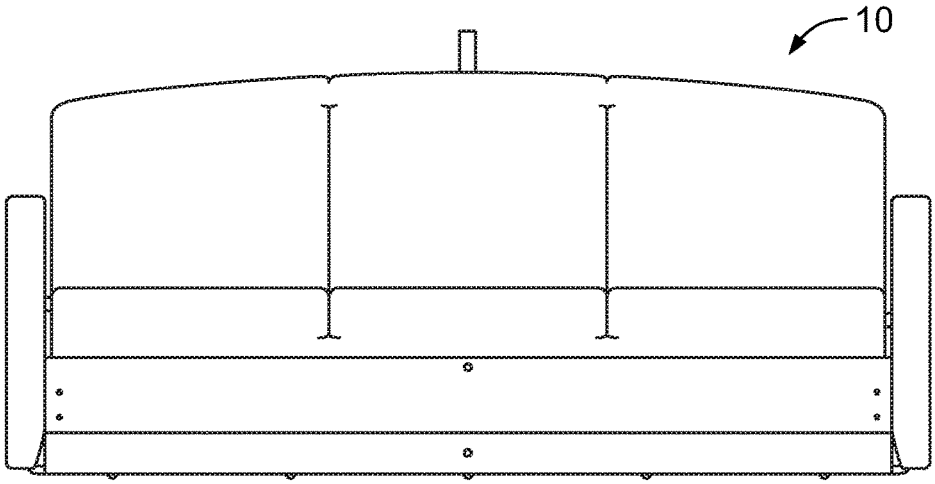
Figure 4B:
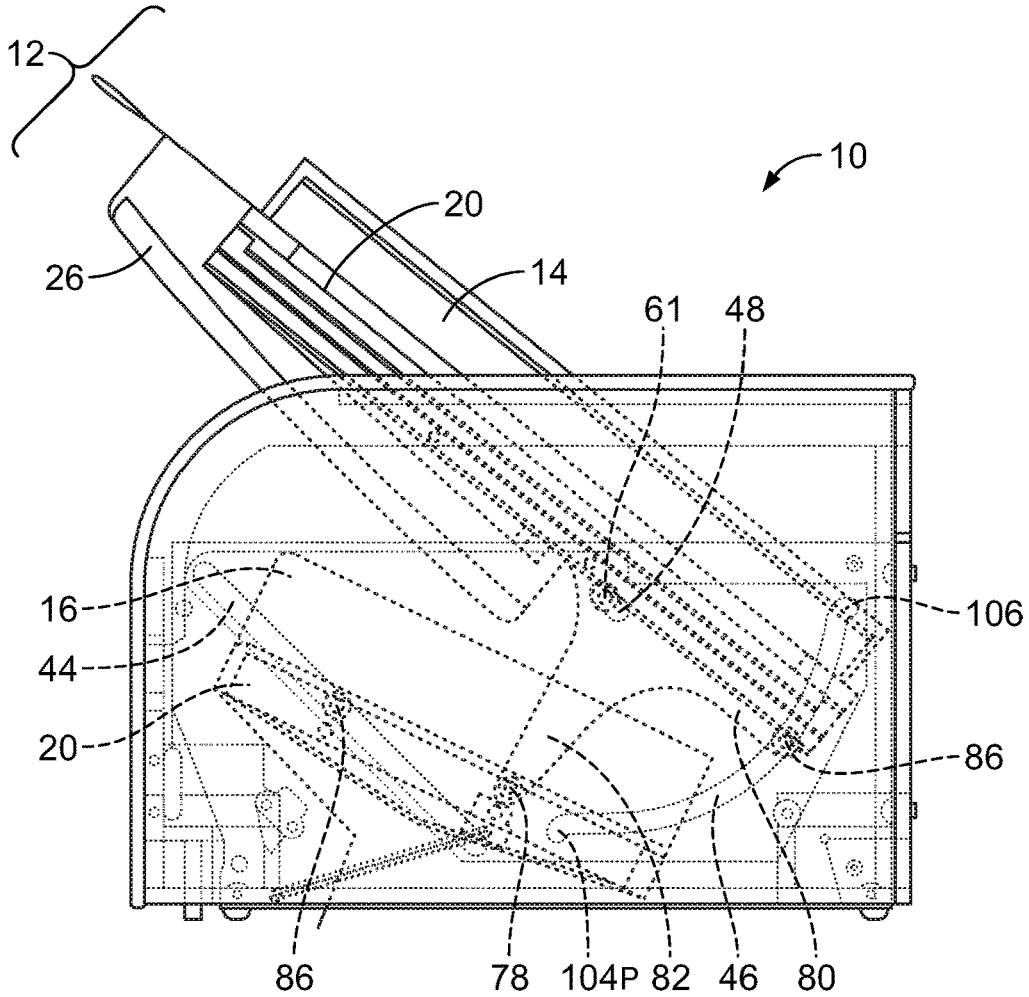
Figure 5A:
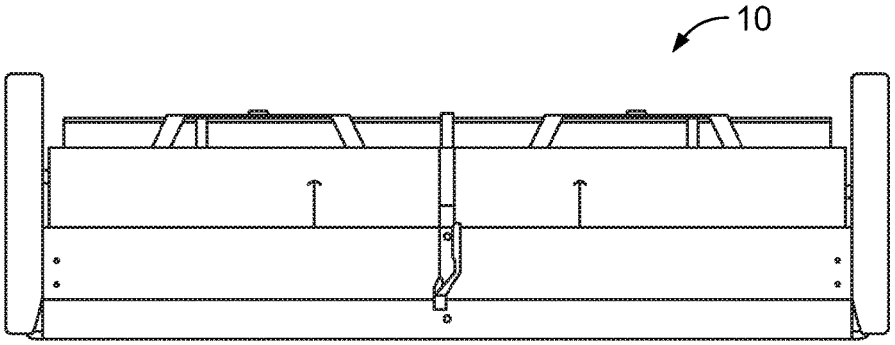
Figure 5B:
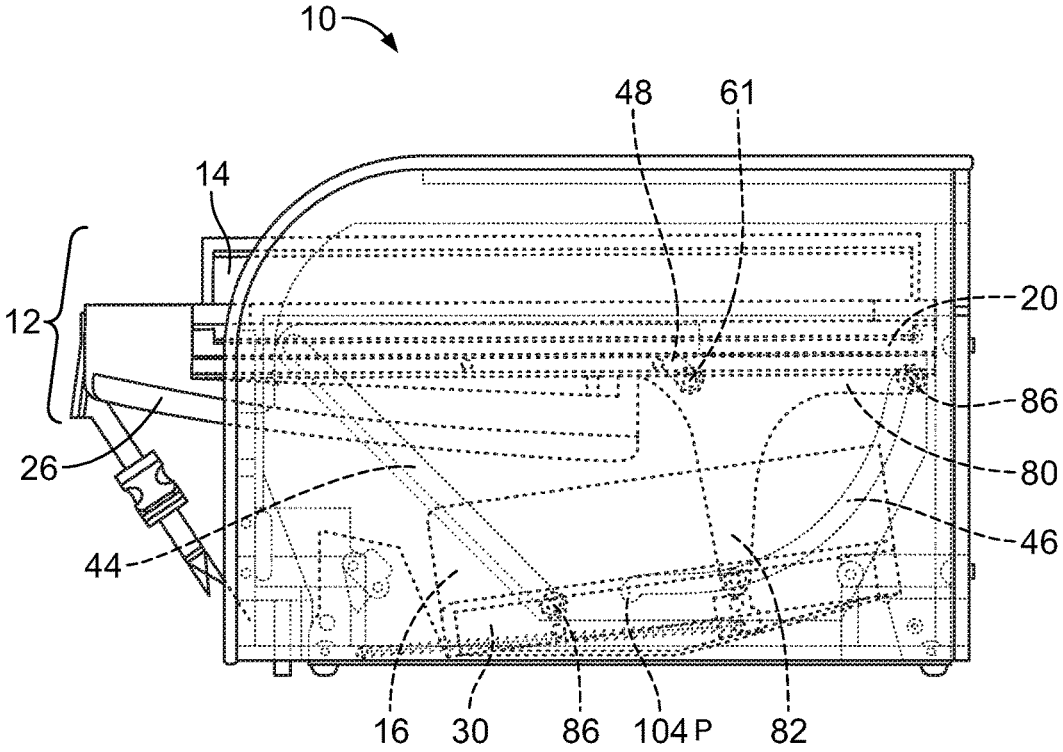

The movement is shown in FIGS. 3-5, which are views taken at different locations. FIG. 3 shows the sofa bed 10 in the sofa position; FIG. 5 shows the sofa bed 10 in the bed position; and FIG. 4 shows the sofa bed during conversion from the sofa position to the bed position or vice versa.

Figure 8:
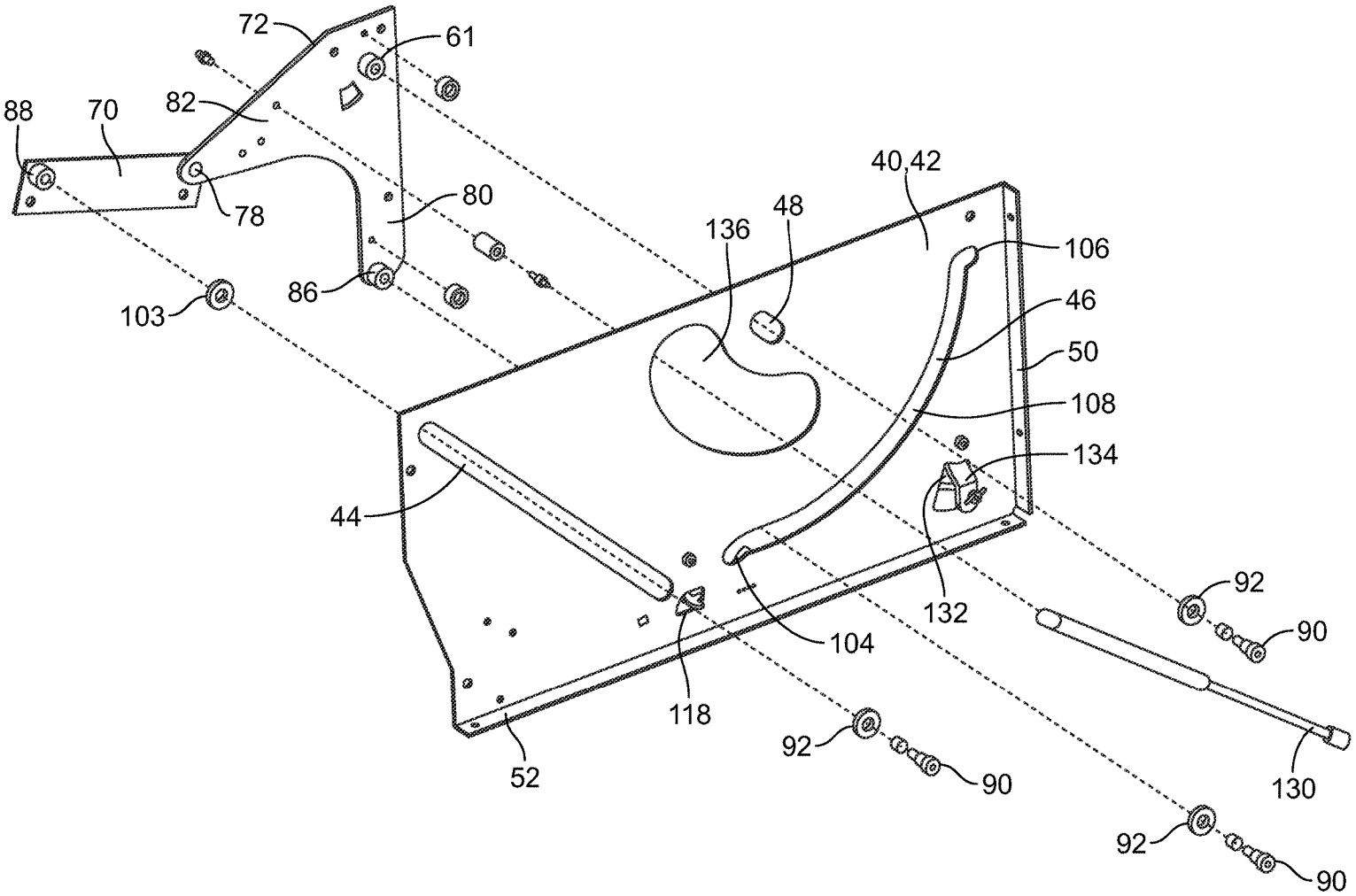
FIG. 8 is an exploded perspective view of a right side frame and link assembly according to an embodiment of the present invention.
Figure 9:
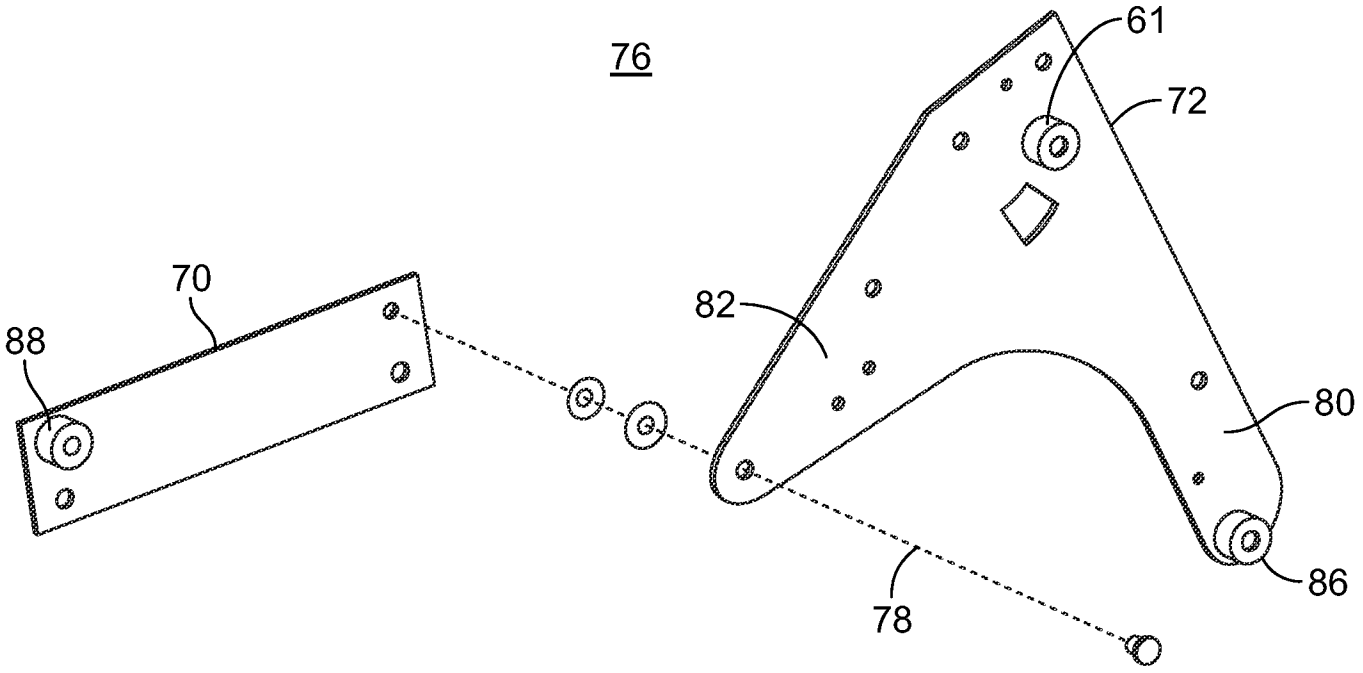
FIG. 9 is an exploded perspective view of the link assembly including the crank member and the seat link member.

In an embodiment, each of the connections 61, 78, 86, 88 is configured in a similar manner using, for example, bolts, spacers, collars and bushings. This arrangement of attachment is enabled by the use of the previously described sheet metal material for frames 40, 42 and the use of a threaded shoulder bolt 90 and flanged roller bushing 92. One of ordinary skill, with the disclosure herein, and particularly FIGS. 18*a*-19*b* will see that bolt 90 has head 94 and shoulder 96 with extending shank 98 that can be placed within the cylindrical portion 100 of bushing 92. Bushing 92 is fitted on shoulder 96 so as to prevent direct contact, and a larger bearing surface protecting from contact between, for example in FIG. 8, direct contact between leg 82 and seat link member 70 and due to the rotationally free condition of bushing 92, a reduction of friction can be achieved as there is relative motion between leg 82 and seat link member 70. Connections 61, 86, 88 will be configured according to these principles, with flange 102 providing a thrust bearing like function where located in the sliding connections, 61, 86, 88 by being located outside the respective frames 40, 42. A collar may also be provided between the bolt 90 and bushing 92, as shown in FIG. 8. It should also be noted that link 70 may also be vertically reversed with the seat bearing connection 88 and pivot joint 78 connection being made at the lower holes of the seat link 70. Spacer bushing 103 is used on seat link member 70 with a longer bolt to put all the sliding connections 61, 78, 86, 88 in substantially the same plane. Shank 98 may be threaded to receive a nut, internally threaded to receive a corresponding bolt, or simply flattened in the manner of a rivet, or fastened using other methods.

The pivot slot 48 is constructed such that the main pivot 61 is allowed some sliding movement in the plane of the side frame 40, 42. Each seat link member 70 is also attached to the corresponding side frame 40 by connection 86 at the arcuate guide 46. The ends of the arcuate guide 46 in the prior art have lower detent 104P and the upper end of the arcuate guide has an upper detent 106. In the prior art embodiment the center arc 108 extends about 92.5 degrees, which each detent 104P, 106 having its center an additional, about 3 degrees beyond arc 108. Guide 44 extends at an angle of about 45 degrees. Slot 48 is approximately parallel to guide 44. Slot 48 in the prior art and in the preferred embodiment extends from a top end 109 spaced to the rear of the frame from a vertical line above detent 104. Typically this would be between about one and one-half to about two inches. The center of top end 109 is also located somewhat above a horizontal line from detent 106. The angular offset of this center from the top end of arc 108 is about 6.3 degrees. These relationships provide a unique balance of motion and stability that result in unexpected ease of movement, while preserving a comfortable seating arrangement. In particular the motion enabled by slot 48 having both a vertical and horizontal component add a natural movement for the person deploying the sofa bed, with leverage and the balanced arrangement of seat back assembly 12 contributing to ease of motion and stability when deployed.

The lock and release mechanism 110 locks the sofa bed 10 in place when the sofa bed 10 reaches a predetermined position, such as the sofa position. The lock and release mechanism 110 releases the sofa bed from the locked positioned upon activation of the release mechanism. The lock and release mechanism 110 may be provided on one or both of the side frames 40, 42. In the embodiment shown in FIGS. 8-12, the lock and release mechanism is a hook and cable lock and release mechanism 110.

The hook and cable lock and release mechanism 110 includes a lock arm 112, a release arm 114 and a release cable 120. These elements are shown in detail in FIGS. 10-12. The lock and release mechanism 110 may be attached to the side frame 40, 42 at a position adjacent to the lower detent 118, as illustrated in FIGS. 10 and 12. The lock arm 112 of the lock and release mechanism 110 is curved so that the shape of the arm corresponds to the shape of the lower detent 118. Spring 122 biases the lock and release mechanism in the closed or locked position. Release cable 120 is attached to release arm 114. As such, when release cable is pulled away from the lock and release mechanism, the release cable pulls on the release arm extending spring 122 and moving the lock and release mechanism from the closed position to the open position.

Referring to FIG. 3*b*, in an embodiment, the seat back bearing connection 86 is positioned in the lower detent 104 when the sofa bed 110 is in the sofa position. Accordingly, when in the sofa position, slidable connection 86 is positioned in the lock groove 124 of the lock arm 112, and the sofa bed is locked in place. Pulling the release cable 120 moves the lock and release mechanism 110 to the open position, which then allows the sofa bed 10 to be converted from the sofa position to the bed position.

As shown in FIGS. 3B-5B, in the prior art the seat back bearing connection 86 moves from the upper detent 106 to the lower detent 104P when converting the sofa bed 10 from the sofa position to the bed position. In a locking embodiment, before reaching the lower detent 104, the slidable connection 86 contacts an inclined contact surface 126 of the lock and release mechanism 110, which is biased in the closed position by spring 122. In a locking embodiment, the contact surface 126 is angled towards the locking groove 124 so that the lock and release mechanism is forced open upon application of sufficient force to the contact surface 124. Accordingly, there is no need to pull the release cable 120 when converting the sofa bed from the bed position to the sofa position.

In an embodiment, the lock and release mechanism 110 may further comprise catch 116 for restricting movement of the lock and release mechanism both when the cable is pulled and when the lock and release mechanism 110 is in the biased position. In an embodiment, catch 116 is located on the release arm 114 of the lock and release mechanism 110. As shown in FIGS. 8-12, the side frames 40, 42 include a catch hole 118 that receives catch 116. The catch 116 and catch hole 118 allow the release cable 120 to be pulled a sufficient distance to release the lock and release mechanism 110 from the locked position, but also prevents the cable release from being pulled too far, which may, for example, cause damage to spring 122. The catch 116 and catch hole 118 may also function to stop the lock and release mechanism 110 once in the locked position, thereby preventing the lock and release mechanism 110 from moving too far.

Connection of the lock and release mechanism 110 to the side frames 40, 42 can be made in a variety of ways, as would be understood by those of ordinary skill in the art. In the embodiment shown in FIGS. 8-12 connection is made by way of bolts, washers/spacers and nuts, but could also be made, e.g., by rivets or other fastening methods.

As noted above, sofa arms may be mounted to side frames 40, 42. Accordingly, sofa arms may be configured to allow actuation of the release cable 120 from outside of the sofa arm. This activation may be enabled by, for example, extending the release cable outside of the sofa arm or connecting the release cable to a mechanical or electromechanical lever or button provided in the sofa arm.

In an embodiment, the side frame 40, 42 link assembly 76 structure may also include a limiter 130 that provides some resistance when converting from the sofa position to the bed position and/or from the bed position to the sofa position. In an embodiment, limiter 130 may be a gas spring 130. To accommodate limiter 130, side frame 40, 42 includes aperture 132 and raised member 134. One end of raised member 134 is attached to the side of frame 40, 42 that faces the link assembly 76. The raised member 134 then projects through aperture 132 and sufficiently away from the side frame 40, 42 so that limiter 130 can be angled inwardly through limiter hole and towards crank member 72. One end of limiter is attached to raised member 134, and the other end is attached to the leg 82 of crank member 72 between pivot joint 78 and main pivot 61.

As shown in FIGS. 3-5, when converting from the sofa position to the bed position, the leg 82 of the crank member 72 swings towards arcuate guide 46 and raised member 134. This in turn compresses the gas spring/limiter 130. Also, when converting from the bed position to the sofa position, leg 82 swings away from raised member extending the gas spring/limiter 130. Accordingly, an additional resistance can be applied when converting from the sofa position to the bed position and/or converting from the bed position to the sofa position. This additional resistance can prevent injury which may be caused by inadvertent conversion or the slamming shut open of the seat back assembly 12 during conversion.

During conversion, the swinging of leg 82 in turn moves the end of the limiter attached to the leg 82. To accommodate the movement of the limiter the limiter hole 136 is sized and shaped in such a way so as to prevent the limiter/gas spring 130 from contacting the side frame 40, 42 during conversion of the sofa bed from one position to another.

FIGS. 13-17 show the side frames 40, 42, link assembly 76 and lock and release mechanism 140 according to another embodiment of the present invention. The embodiment shown in FIGS. 13-17 includes many features previously described with reference to FIGS. 8-12, and similar features are designated by the same reference numerals. Differently, the embodiment shown in FIGS. 13-17 includes a lever lock and release mechanism 140 rather than the hook and cable lock and release mechanism of FIGS. 8-12. Similar to the embodiment shown in FIGS. 8-12, the lock and release mechanism 140 locks the sofa bed in place when the sofa bed 10 reaches a predetermined position, such as the sofa position. The lock and release mechanism 140 releases the sofa bed from the locked position upon activation of the release mechanism. The lock and release mechanism may be provided on one or both of the side frames.

Referring to FIGS. 13-17, the lever lock and release mechanism 140 includes body 142, lever arm 144 and mating projection 146. Additionally, the seat link member 70 is modified to be longer than that shown in FIGS. 8-12. The seat link member 70 includes a notch 148 formed in the end 150 of the seat link member 70 that is opposite to slidable connection 86 and a groove 152 formed in the upper edge of the seat link member between the notch 148 and the pivot joint 78.

As shown in detail in FIG. 14, the lock and release mechanism 140 is attached to crank member 72. Opening 154 is formed in the crank member 72 and accepts matting projection 146. One end of spring 160 is attached to the body 142 of the lock and release mechanism 140, and the opposing end of spring 160 is attached to leg 82 by way of spring attachment 164. Spring 160 biases the lock and release mechanism 110 in a locked or closed position, during which the lever is moved away from the crank member.

As described above with reference to FIGS. 8-12, seat link member 70 is pivotably attached to crank member 72 at pivot joint 78. The seat link member 70 extends sufficiently away from pivot joint towards end 150 so that notch 148 can mate with mating projection 146 when end 150 swings towards mating projection 146 as the sofa bead 10 reaches a predetermined position. Groove 152 may, for example, accommodate a rivet or screw attached to crank member 72 when end 150 engages with the mating projection 146. This prevents the top edge of seat link member from contacting the rivet prior to end 150 reaching mating projection 146.

In the embodiment shown in FIGS. 13-17, the length of the seat link member 70 and the position of the opening 154 and lock and release mechanism 140 are configured such that mating projection 146 engages with notch 148 when the sofa bed 10 is in the sofa position. Accordingly, when the sofa bed 10 is in the sofa position, the sofa bed 10 is locked in place and cannot be converted until the mating projection 146 is released from notch 148.

To release the sofa bed from 10 from the sofa position, the lever arm 144 is moved towards the crank member 72. Moving the lever arm 144 towards crank member 72 causes mating projection 146 to move away from the seat link member 70 and out of notch 148. Once the mating projection 146 is removed from notch 148, the seat link member is free to move and the sofa bed 10 can be converted from the sofa position to the bed position.

In an embodiment, end 150 includes an angled contact surface 162 which is angled inward from the notch 148 to the top edge of the seat link member 70. As shown in FIGS. 3-5, the slidable connection 86 moves from the upper detent 106 to the lower detent 104 when moving the sofa bed 10 from the sofa position to the bed position. Before reaching the lower detent 104, the angled contact surface 162 contacts the mating projection 146 of the lock and release mechanism 110, which is biased in the locking position by spring 122. Since, the contact surface 162 is angled, the lock and release mechanism is forced to the open/unlocked position when sufficient force is applied to the contact surface 162. Accordingly, there is no need to push in the lever arm 144 when converting the sofa bed from the bed position to the sofa position.

Connection of the lock and release mechanism 140 to the side frames 40, 42 can be made in a variety of ways, as would be understood by those of ordinary skill in the art. In the embodiment shown in FIGS. 8-12 connection is made by way of rivets, but could also be made by, for example, bolts, screws, washers, spacers, nuts or another other fastening method.

As noted above, sofa arms may be mounted to side frames 40, 42. Accordingly, sofa arms may be configured to allow actuation of the release cable 120 from outside of the sofa arm. Accordingly, the lever arm 144 may be pushed or actuated by, for example, a mechanical or electromechanical arm lever or button.

In an embodiment, the side frame 40, 42 link assembly 76 structure shown in FIGS. 13-17 may also include a limiter 130 that provides some resistance when converting from the sofa position to the bed position and/or from the bed position to the sofa position. In an embodiment, limiter 130 may be a gas spring 130. The limiter 130 may be incorporated in the same way as described above with reference to FIGS. 8-12.

The sofa bed conversion operates in the following way. With reference to the seating position in FIG. 3, the lock and release mechanism is opened/released and the seat back frame 20 is pulled forward and slightly up at its top. This action allows the main pivot 61 to move upwardly and forwardly in the pivot slot 43 and the lower connection 86 to be moved out of contact with end 104. As the seat back frame 20 is pulled further forward, rotating about the main pivot 61, the fastener connection 86 moves along the arcuate guide 42 center arc 108 towards the upper end 106. Simultaneous with the movement of the seatback frame 20, the arm 82 exerts a downward force at the seat pivot connection 78. It will be noted that arm 82 is angled slightly downwardly from a line through link 70 providing a slight over center locking condition in assembly 76.

The downward movement pulls the seat down and rearward and the seat is guided in this movement by the seat link connection 88 moving in the diagonal guide 44. When the seat back frame 20 reaches a horizontal position, the seat back bearing connection 86 reaches the detent 106 at the upper end of the arcuate guide 46 where it engages the detent 106 to provide a semi-locking condition somewhat limiting inadvertent conversion from bed to sofa.

The bed is converted to a sofa in substantially the reverse manner. The seat back frame 20 is pulled forward and slightly up at what is generally understood to be the front of the sofa. This action disengages the seat back bearing connection 86 from the detent 106 at the upper end of the arcuate guide 46 and allows the main pivot 61 to slide in the pivot slot 48. As the seatback frame 20 is moved farther upwards, it pivots about the main pivot 61 and the seatback bearing connection 86 moves along the center arc 108 of the arcuate guide 44 towards the lower end 104. Simultaneous with the movement of the seatback frame 20, the link assembly 76 exerts a force on the seat frame 30 through the pivot 78. This force moves the seat frame 30 upwards and forward out of the cavity as it is guided in this travel by the seat bearing connection 88 moving in the diagonal guide 46. When the seatback reaches its seating position, the seatback bearing 86 has also reached the lower end of the arcuate track and reaches the end 104 located there, urging arm 82 upward, and locking the seatback bearing 86 into the locked position of the lock and release mechanism.

In this manner the two sided seat back or mattress platform 20 is connected in a semi-balanced manner around a main pivot 61 in an angled slot 48. The platform 20 has a seat back cushion 26 on a first side and a mattress 14 on a second side and is also pivotally linked with a crank member 72 to a seat link 70, in turn attached to a seat frame, 30 at pivot 78. The respective mattress platform 20 and seat 30 are slidably connected in an arcuate 46 and angled guide 44 respectively, the main pivot 61 being disposed therebetween. Movement of the top of the seat back 20 imparts downward movement on the rear of seat 30, the seat 30 descending to a lower stored position while the mattress 14 is deployed to a top horizontal position.

In summary, the two alternative locking embodiments of FIGS. 8, 10A, 10B, 11, 12, 13, 15A, 15B, 16 and 17 rely on locking the mechanism in lieu of detent 104P FIG. 8, 11, 15A, 15B, show a track 46 usable for either locking embodiment. FIG. 10A, 10B, 12, show the lower lock embodiment. FIGS. 13, 14, 16 and 17 show the upper lock and release mechanism 140 that locks the notched seat link member 70 and crank member 72.

What is claimed is:

1. A sofa bed comprising:

a seat back assembly;

a seat attached to the seat back assembly;

a side frame assembly attached to the seat back assembly and the seat, the side frame assembly comprising, a side frame;

a link assembly connected to the side frame, wherein the link assembly attaches the side frame to the seatback assembly and the seat, and the link assembly moves between a first position and a second position to allow for conversion of the sofa bed between a sofa position and a bed position; and a lock and release member directly locking the link assembly in place;

the side frame comprises a guide;

the link assembly comprises a bearing connection connecting the link assembly to the guide, the bearing connection slides along the guide to which the link assembly is connected when the link assembly moves between the first position and the second position, and the lock and release mechanism is attached to the side frame adjacent to the guide, such that the lock and release mechanism receives the bearing connection and locks the bearing connection in place when the link assembly is in the first position;

a tee shaped member having a lock arm a pivot arm and a cable attachment base;

said lock arm which is sized and shaped to receive the bearing connection, the lock arm receiving the bearing connection and locking the bearing connection in place when the link assembly is moved to the first position;

a spring biasing the lock and release mechanism to a locked position; and said cable attachment base having a release cable is attached, wherein pulling the release cable pulls the cable attachment base extending the spring and moving the lock and release mechanism around a pivot on said pivot arm from the closed position to an open position.

2. The sofa bed of claim 1, wherein the release arm comprises a contact surface and a lock groove, wherein the contact surface is angled towards the lock groove such that the lock and release mechanism is forced open upon application of sufficient force to the contact surface.

3. A sofa bed comprising:

a seat back assembly;

a seat attached to the seat back assembly;

a side frame assembly attached to the seat back assembly and the seat, the side frame assembly comprising, a side frame;

a link assembly connected to the side frame, wherein the link assembly attaches the side frame to the seatback assembly and the seat, and the link assembly moves between a first position and a second position to allow for conversion of the sofa bed between a sofa position and a bed position; and a lock and release member directly locking the link assembly in place;

the link assembly comprises:

a seat link member connected to the side frame;

a crank member connected to the side frame and pivotally connected to the seat link member; and the lock and release mechanism comprises:

a lever locking mechanism attached to the crank member, the lever locking mechanism comprising a mating projection, wherein the mating projection mates with a notch formed in the seat link member directly locking the link assembly in the first position.

4. A sofa bed comprising:

a seat back assembly;

a seat attached to the seat back assembly;

a side frame assembly attached to the seat back assembly and the seat, the side frame assembly comprising, a side frame;

a link assembly connected to the side frame, wherein the link assembly attaches the side frame to the seatback assembly and the seat, and the link assembly moves between a first position and a second position to allow for conversion of the sofa bed between a sofa position and a bed position; and a lock and release member directly locking the link assembly in place;

a seat link member attached to the seat, the seat link member comprising a seat bearing connection connecting the seat link member to the side frame; and a crank member attached to the seat back assembly, the crank member comprising a main pivot, an arm, and a leg, wherein the leg is pivotally attached to the seat link member, and the arm includes a seat back bearing connection connecting the crank member to the side frame, wherein the side frame comprises:

a pivot slot to which the main pivot is pivotally connected and around which the seatback frame rotates;

a diagonal guide formed in the side frame, wherein the seat bearing connection is slidably connected to the diagonal guide; and an arcuate guide formed in the side frame to the rear of the diagonal guide, wherein the seat back bearing connection is slidably connected to the arcuate guide, and wherein travel of crank member is directionally controlled by the side frame diagonal and arcuate guides, angularly controlled by said interconnected seat link member and crank member operating within said link assembly and the relative positions of seatback assembly and seat frame and the forces relating to movement by are additionally controlled by a gas spring, said gas spring reacting to and exerting forces throughout the range of motion.

5. The sofa bed of claim 4, wherein the arcuate guide includes a lower end and an upper end, and the seat back bearing connection slides between the lower end and the upper end, and the lock and release mechanism is attached to the side frame at a position adjacent to the lower end.

6. The sofa bed of claim 5, wherein the lock and release mechanism comprises:

a tee shaped member having a lock arm a pivot arm and a cable attachment base;

said lock arm which is sized and shaped to receive the seat back bearing connection, the lock arm receiving the seat back bearing connection and locking the seat back bearing connection in place when the link assembly is moved to the first position;

a spring biasing the lock and release mechanism to a locked position; and said cable attachment base having a release cable is attached, wherein pulling the release cable pulls the cable attachment base extending the spring and moving the lock and release mechanism around a pivot on said pivot arm from the closed position to an open position.

7. The sofa bed of claim 4, further comprising:

a limiter which provides resistance when converting from the sofa position to the bed position and/or from the bed position to the sofa position, the limiter comprising a first end connected to the crank member and a second end connected to the side frame, said limiter acting through the full range of motion during said conversion, wherein the side frame includes a limiter hole, and the limiter extends from the first end connected to the crank member through the limiter hole and to the second end connected to the side frame.

8. The sofa bed of claim 7, wherein the limiter is a gas spring.

9. The sofa bed of claim 7, wherein the side frame includes a raised member which projects away from the side frame, and the second end of the limiter is connected to the raised member.

10. The sofa bed of claim 4, wherein the lock and release mechanism comprises:

a lever locking mechanism attached to the crank member, the lever locking mechanism comprising a mating projection, wherein the mating projection mates with a notch formed in the seat link member so as to lock the link assembly in the first position.

11. The sofa bed of claim 10, wherein:

a first end of the seat link member is connected to the side frame by way of the first bearing connection, and a second end of the seat link member opposite to the first end includes the notch;

the lever is attached to a first surface of the crank member, and the mating projection projects through a hole formed in the crank member and away from a second surface of the crank member that is opposite to the first surface; and the lock and release mechanism further comprises a spring biasing the lock and release mechanism to the closed position; and moving the lever in a predetermined direction moves the mating projection away from the notch so as to allow the sofa bed to be moved between the sofa position and the bed position.

12. The sofa bed of claim 11, wherein the seat link member includes an angled contact surface angled inward from the notch to a top edge of the seat link member such that the lock and release mechanism is forced open upon application of sufficient force to the contact surface.

* * * * *